US009650173B2

(12) United States Patent
Fowler et al.

(10) Patent No.: US 9,650,173 B2
(45) Date of Patent: May 16, 2017

(54) PRODUCT DISPENSING SYSTEM

(75) Inventors: Paul Michael Fowler, Rockford, IL (US); Matthew Eric Blue, Barrington, IL (US); Ronald T. Klein, Island Lake, IL (US)

(73) Assignee: SAGE PRODUCTS, LLC, Cary, IL (US)

( * ) Notice: Subject to any disclaimer, the term of this patent is extended or adjusted under 35 U.S.C. 154(b) by 1336 days.

(21) Appl. No.: 13/043,584

(22) Filed: Mar. 9, 2011

(65) Prior Publication Data

US 2011/0155612 A1 Jun. 30, 2011

Related U.S. Application Data

(63) Continuation-in-part of application No. 12/761,042, filed on Apr. 15, 2010, now abandoned, which is a continuation of application No. 12/246,066, filed on Oct. 6, 2008, now Pat. No. 7,699,170, which is a continuation of application No. 10/979,659, filed on Oct. 14, 2004, now Pat. No. 7,464,816.

(51) Int. Cl.

| | |
|---|---|
| ***B65D 21/028*** | (2006.01) |
| ***B65D 21/02*** | (2006.01) |
| ***B65D 71/46*** | (2006.01) |
| ***B65D 73/00*** | (2006.01) |
| ***B65D 75/36*** | (2006.01) |

(52) U.S. Cl.

CPC ..... *B65D 21/0204* (2013.01); *B65D 71/46* (2013.01); *B65D 73/0071* (2013.01); *B65D 75/367* (2013.01)

(58) Field of Classification Search

CPC .. B65D 21/0204; B65D 71/46; B65D 75/367; B65D 73/0071; B65D 75/323; A45C 7/0086

USPC ..... 206/820, 471, 461, 806, 538; 229/237; 383/37, 38

See application file for complete search history.

(56) References Cited

U.S. PATENT DOCUMENTS

| | | | | |
|---|---|---|---|---|
| 3,288,280 | A | 11/1966 | Bostrom | |
| 3,749,237 | A * | 7/1973 | Dorton | 206/438 |
| 3,780,856 | A * | 12/1973 | Braverman | 206/534 |
| 3,970,194 | A | 7/1976 | Iten | |
| 4,168,002 | A * | 9/1979 | Crosby | 206/459.5 |

(Continued)

*Primary Examiner* — Steven A. Reynolds
(74) *Attorney, Agent, or Firm* — Foley & Lardner LLP

(57) ABSTRACT

A product dispensing system and a method of queuing usage of products. In one form, a plurality of layers of products, each having multiple items in separate packages, is provided, each layer having a carrier with the separate packages being secured to and extending from the carrier. The layers are assembled in a stacked orientation behind a front layer with layers behind the front layer being at least partially concealed and inaccessible. Products are used one layer at a time, and when the separate packages from the front layer are removed, the packages of the next-succeeding layer are exposed for use. In another form of the invention, the packages for each layer are secured to and extend in series from the carrier for each layer, with a first package secured to the carrier for the layer, and each succeeding package being secured to the next preceding package. The carrier and packages of each layer are secured to one another with successive package connections of increasing strength with increasing distance from a package most distant from the carrier.

9 Claims, 5 Drawing Sheets

(56) References Cited

U.S. PATENT DOCUMENTS

| | | | | | |
|---|---|---|---|---|---|
| 4,301,575 | A | | 11/1981 | Goldberg | |
| 4,457,964 | A | * | 7/1984 | Kaminstein | 428/43 |
| 4,474,300 | A | | 10/1984 | Entis | |
| 5,322,077 | A | * | 6/1994 | Corella | 132/323 |
| 5,562,964 | A | * | 10/1996 | Jones | 428/43 |
| 5,855,282 | A | | 1/1999 | Hardy | |
| D423,344 | S | * | 4/2000 | Kumakura et al. | D9/415 |
| 6,139,932 | A | * | 10/2000 | Kline | 428/41.8 |
| 6,164,617 | A | * | 12/2000 | Butterfield et al. | 248/690 |
| 6,311,845 | B1 | | 11/2001 | Uren et al. | |
| 6,401,304 | B1 | * | 6/2002 | Dossett | 24/16 PB |
| 6,439,390 | B1 | * | 8/2002 | Kumakura et al. | 206/705 |
| 6,446,819 | B1 | | 9/2002 | Mattesky | |
| 6,446,932 | B1 | | 9/2002 | Butterfield et al. | |
| 6,450,335 | B1 | | 9/2002 | Yates | |
| 6,460,727 | B1 | * | 10/2002 | Irwin | 221/63 |
| 6,536,624 | B2 | * | 3/2003 | Johnson et al. | 221/45 |
| D482,970 | S | * | 12/2003 | Kumakura et al. | D9/457 |
| 6,708,826 | B1 | | 3/2004 | Ginsberg et al. | |
| 6,991,840 | B2 | * | 1/2006 | Sosalla | 428/43 |
| 7,028,376 | B2 | | 4/2006 | Mattesky | |
| D548,618 | S | * | 8/2007 | Ferguson et al. | D9/732 |
| 2002/0166824 | A1 | * | 11/2002 | Mattesky | 211/1 |
| 2003/0136698 | A1 | | 7/2003 | Klatt | |

* cited by examiner

PRODUCT DISPENSING SYSTEM

RELATED APPLICATION

This application is a continuation-in-part of co-pending U.S. patent application Ser. No. 12/761,042, filed Apr. 15, 2010 which is a continuation of U.S. patent application Ser. No. 12/246,066, filed Oct. 6, 2008, now U.S. Pat. No. 7,699,170, which is a continuation of U.S. patent application Ser. No. 10/979,659, filed Oct. 14, 2004, now U.S. Pat. No. 7,464,817.

BACKGROUND OF THE INVENTION

This invention relates to product dispensing systems and queuing usage of products, and in particular to a system having a plurality of layers of products, with each layer having multiple items in separate packages which can then be dispensed in a layer-by-layer fashion.

Often times products are used in a multiple and repetitious manner. For example, in medical care and with particular reference to oral care, often a series of oral care products is used in a repetitious manner, for example in periodic cleaning sessions, where there can be evacuation, brushing of the teeth, and swabbing of the mouth and gums. Different implements are used for each procedure, and with the repetition of each series of procedures at predetermined intervals, such as every few hours, it is advantageous to have all of the necessary implements available to the oral care professional in an organized and logical manner. This not only facilitates proper care, but also helps avoid missing any critical care steps each time oral care is undertaken.

SUMMARY OF THE INVENTION

The invention is directed to a product dispensing system comprising a plurality of layers of products, with each layer having multiple items in at least two separate packages. A carrier is provided for each layer, the packages for each layer being secured to and extending in series from the carrier for each layer, with a first package being secured to the carrier for the layer, and each succeeding package being secured to the next preceding package. The carrier and packages of each layer are secured to one another with successive package connections of increasing strength with increasing distance from a package most distant from the carrier.

In accordance with one form of the invention, the carrier comprises a separate carrier for each layer, with the separate carriers being connected to one another. In another form of the invention, the carrier comprises a common carrier for the plurality of layers.

In the preferred form of the invention, the successive package connections comprise progressive perforations. The progressive perforations may comprise bridges for each package connection, with increasing numbers of bridges for each package connection from the package that is most distant from the carrier. In one form, the bridges for each package connection increase in width for each package connection from the package most distant from the carrier. The bridges for each package connection also decrease in effective spacing for each package connection from the package most distant from the carrier. The bridges for each package connection commence at a start location spaced inwardly from an outer package edge, and the start location for each package connection decreases in spacing from the outer package with increasing distance from the package most distant from the carrier.

In all forms of the inventions employing bridges, the bridges increase in strength for each package connection from the package most distant from the carrier. The design of the invention permits a single-hand pull and removal of the bottom-most package of a layer without removing the next package.

BRIEF DESCRIPTION OF THE DRAWINGS

The invention is described in greater detail in the following description of examples embodying the best mode of the invention, taken in conjunction with the drawing figures in which.

DESCRIPTION OF EXAMPLES EMBODYING THE BEST MODE OF THE INVENTION

Figure 3:
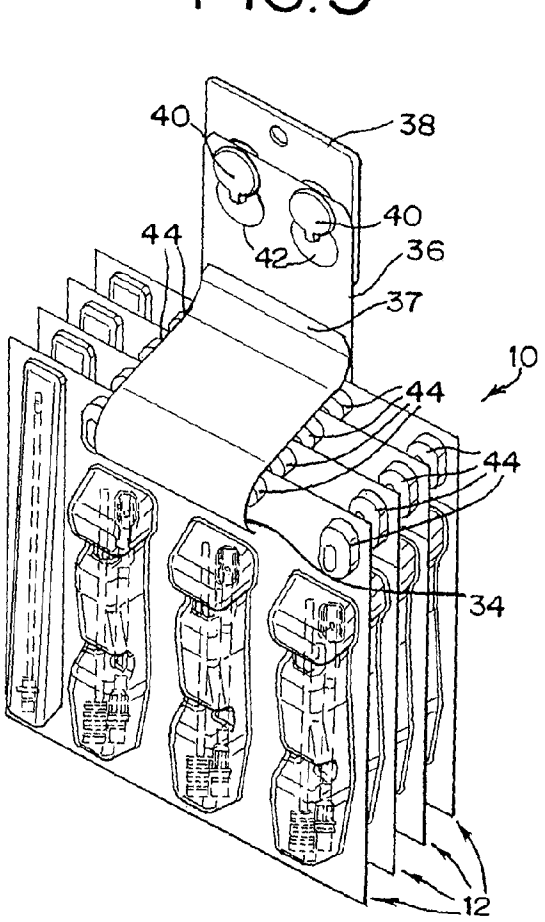
FIG. 3 is a perspective view thereof.
Figure 2:
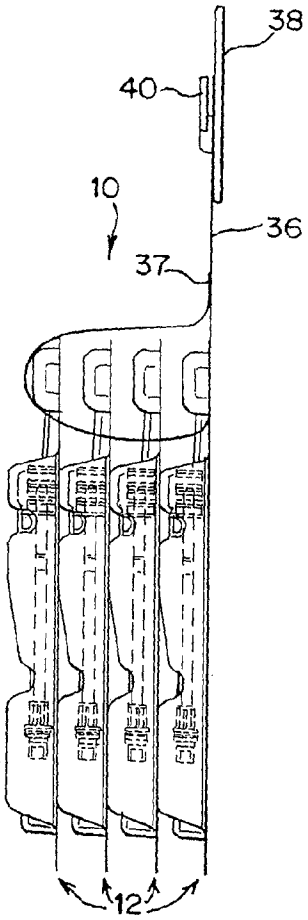
FIG. 2 is a side elevational illustration thereof.
Figure 1:
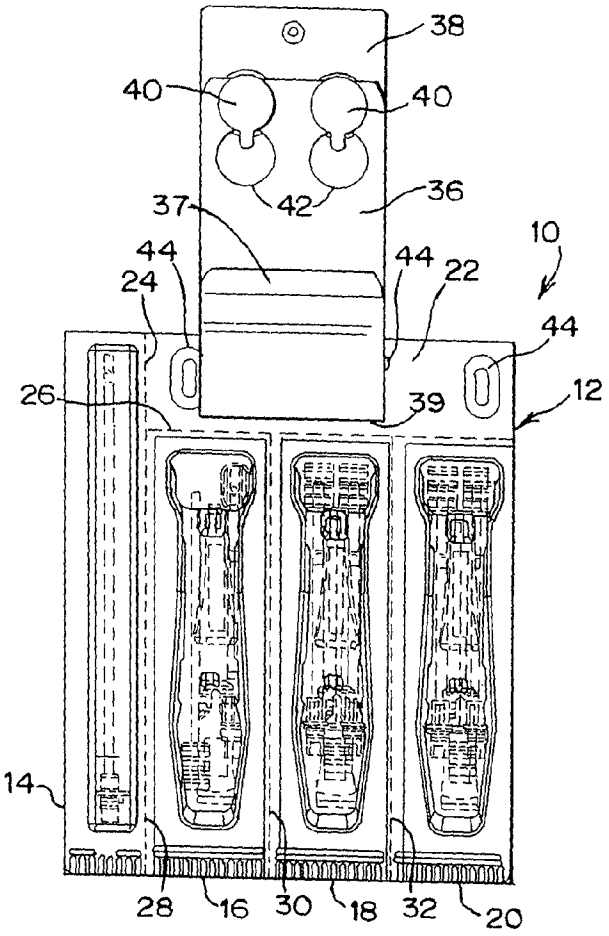
FIG. 1 is a front elevational illustration of a product dispensing system according to the invention, with its hang strap and bracket.
Figure 4:
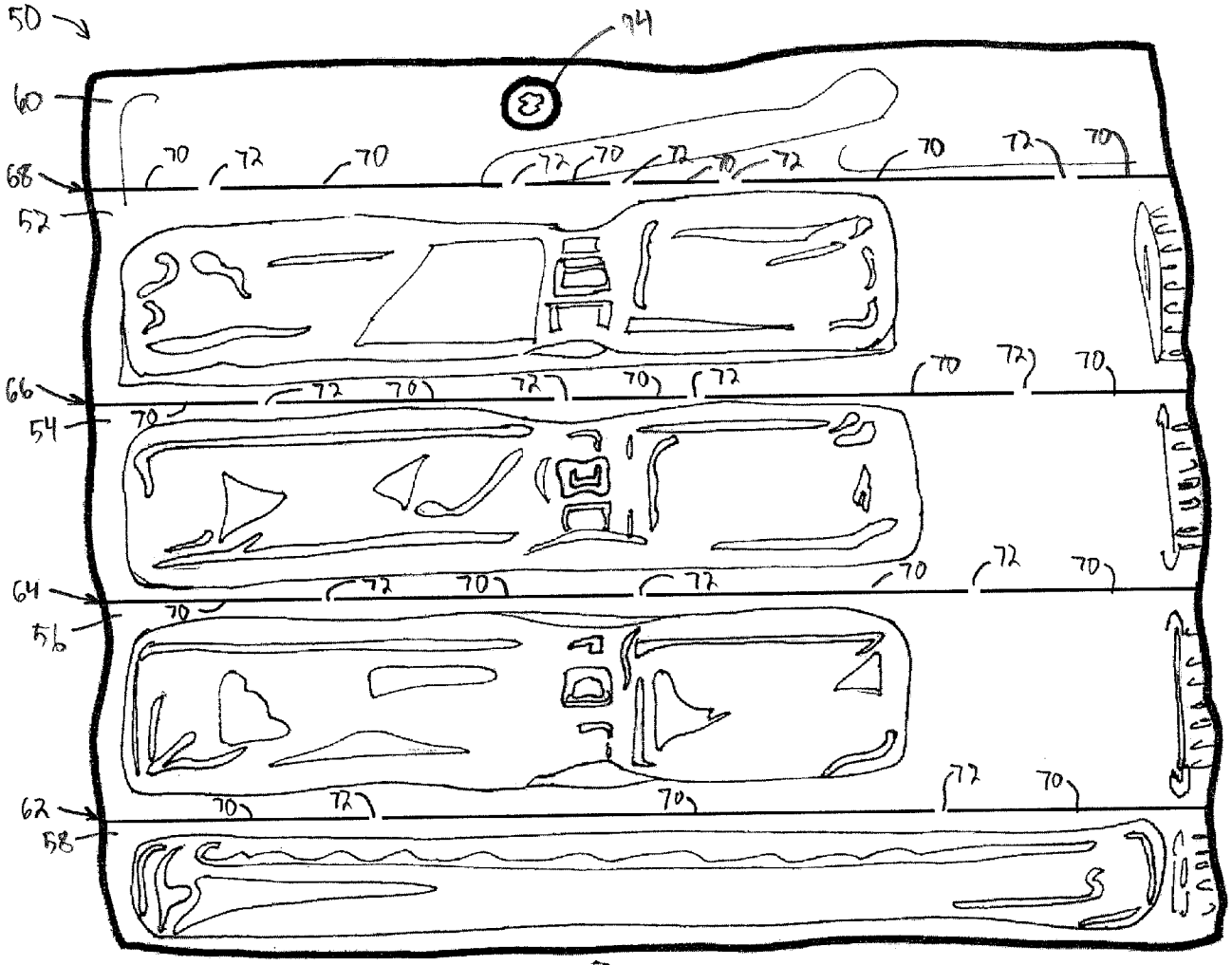
FIG. 4 is a front elevational illustration of a second form of the product dispensing system according to the invention.

A first form of a product dispensing system according to the invention is shown generally at 10 in drawing FIGS. 1-3. The product dispensing system 10 is comprised of a plurality of layers of products 12, each layer having multiple items in separate packages 14, 16, 18 and 20. While four packages are illustrated, any number of packages can compose each of the layers 12. Preferably the layers are identical to one another, although that is not mandatory.

Each of the separate packages 14 through 20 contains whatever item or items are desired, such as, for oral care, catheters, tooth brushers, oral care swabs and cleansing and moisturizing solutions, as needed. What items may be included in each of the separate packages 14 through 20 forms no part of the invention, and what is illustrated in the drawing figures is simply for the purposes of explanation.

The packages 14 through 20 are secured to and extend from a carrier 22. Some means of promoting severing of the packages 14 through 20 from the carrier 22 is provided, such as perforations 24 and 26, as illustrated in FIG. 1.

The packages 14 through 20 are shown joined to one another, although that is not mandatory. If joined, the packages 14 through 20 join at adjoining edges, and may be severed from one another along perforations 28, 30 and 32.

As illustrated, the layers 12 are assembled in a stacked orientation with layers behind a front layer (the left most layer in FIG. 2) being at least partially concealed and therefore inaccessible. For assembling the layers in that orientation and for suspending the product dispensing system 10 for use, each of the carriers 22 includes a slot 34, and a hang strap 36 is threaded through each of the slots 34, the hang strap 36 being looped and joined appropriately to itself at 37, such as by heat sealing, adhesives or any other means of affixing it to form a loop. The loop thus-formed can be as large as desired, and in some instances can be sufficiently large so that one or more additional packages can be slipped into the loop above the plurality of layers of products 12. Thus, when the product dispensing system 10 is used for oral care, a single irrigating device, which can be used with a catheter found in one of the packages of each of the layers of products 12, can be provided and thus reused as each layer is accessed.

For suspending the product dispensing system for easy accessibility and use, a bracket 38 may be included which can be appropriately affixed to a wall or any other vertical surface. The bracket 38 includes a pair of hooks 40 and the hang strap 35 includes a corresponding pair of apertures 42 in registration with the hooks 40.

Each of the separate packages 14 through 20 has a particular depth, which promotes separation of the layers 12 when assembled as shown in the drawings. However, the carriers 22 typically are generally flat, and have very little depth. Therefore, a series of separators 44 is provided on each of the carriers 22 to help maintain spacing of the layers of products 12. The separators 44 comprise bulges which extend from the carriers 22, thus adding depth to the carriers 22 and promoting proper spacing as shown in the drawing figures.

The system 10 according to the invention provides a method of queuing the usage of products. The layers of products 12 are provided, each with its separate packages 14 through 20, each of the packages being individually accessible and severable from the carrier 22. With the layers in a stacked orientation, the layers of products 12 behind the front layer (the left-most layer in FIG. 2) are at least partially concealed and inaccessible. Once the items in the separate packages 12 through 14 have been appropriately used, the packages can be severed from one another along the perforations 28 through 32, and the packages can also be removed from the carrier 22 along the perforations 24 and 26, thus exposing the next-succeeding layer of products 12. The items in the separate packages of that layer can then be accessed and used, and the process repeated for each of the layers of products 12.

While four separate packages 14 through 20 are illustrated, with the package 14 being shown as longer than the other packages, it will be apparent that any number of packages can be utilized, extending from an appropriately sized carrier 22. Also, while the packages 14 through 20 are preferably formed in a "card" or layer as illustrated with perforations 28 through 32 for severing purposes, the separate packages 14 through 20 can also be spaced from one another rather than contiguous.

The layers of products 12 are shown generally one behind the other in the drawing figures, suspended from a flexible hang strap 36, such as a plastic strip. The layers of products 12 need not be fully aligned one behind the other, but can be somewhat staggered, if desired. Also, rather than a hang strap 36, a rigid wall bracket, extending through the slots 34, can be used for assembling the layers in their stacked orientation.

A second form of a product dispensing system according to the invention is shown generally at 50 in FIGS. 4-7. Similar to the first form of the invention described above, the product dispensing system 50 is comprised of a plurality of layers of products (only one shown for purposes of description), each layer having multiple items in separate packages 52, 54, 56 and 58. While four packages are illustrated, any number of packages can compose each of the layers, which may be identical to one another, although that is not mandatory.

Each of the separate packages 52-58 contains whatever item or items are desired, such as, for oral care, catheters, toothbrushes, oral care swabs, and cleansing and moisturizing solutions. Such items are illustrated graphically in FIGS. 4 and 5, but are removed for clarity in FIGS. 6 and 7. What items may be included in each of the separate packages 52-58 forms no part of the invention, and what is illustrated in the drawing figures is simply to aid explanation.

The packages 52-58 are secured to and extend from a carrier 60. A separate carrier 60 may be provided for each of the layers, or a single carrier 60 can be provided, from which the packages 52-58 for each layer extend. No matter whether there is a single carrier for all layers, or a carrier 60 for each layer, the packages 52-58 extend in series from the carrier.

The carrier 60 and packages 52-58 of each layer are secured to one another with successive package connections of increasing strength with increasing distance from the package most distant from the carrier, in this instance that being the package 58. Thus, package connections 62, 64, 66 and 68 are illustrated in the drawing figures.

As explained further below, the package connections 62-68 are of increasing strength for each connection from the package connection 62 upward. Thus, when the system 50 is hanging from a bracket, a person wishing to remove the lower package 58 can remove it by pulling downwardly on it, without severing the package connections 64-68. Then, the user can remove the package 56 similarly, without removing the packages 52 and 54, and so on until the package 52 is ultimately severed at the package connection 68 from the carrier 60. The package connections 62-68 are illustrated as perforations in the drawing figures, but can be other means of connection, as well, so long as they satisfy the requirement of increasing strength with increasing distance from the package most distant from the carrier 60. Therefore, for example, if the package connections are solid rather perforated, the thickness of each package connection can increase upwardly to the carrier 60, so that the lower most package connection is the thinnest. Other means of package connections, meeting the goal of increasing strength, will be evident to those skilled in the art.

To accomplish the means of connection as explained above, the package connections 62-68 comprise progressive perforations. That is, the perforations, as explained below, are progressively more robust from the package connection 62 to the package connection 68. That robustness is due to several factors as described below, including the number of the perforations, the spacing or location of the perforations, the widths of the perforations and even the material of the perforations.

Each package connections 62-68 is composed of two portions, fully cut or severed portions 70, and bridges 72. The bridges 72 are often also denoted as nicks, gates or landings, but the term bridge is used throughout this specification.

The package connection 62 has two bridges 72, separated by an intermediate cut portion 70 with outer cut portions 70, as illustrated. Similarly, the next succeeding package connection 64 includes three bridges 72, separated by cut portions 70. The package connection 66 includes four bridges 72, separated by cut portions 70, and the package connection 62 includes five bridges 72, separated by cut portions 70, all as illustrated.

In addition to the number of bridges increasing from the package connection 62 to the package connection 68, preferably the widths of the bridges 72 for most of the package connections 62 increase from the package connection 62 to the package connection 68. Also, the bridges 72 for each package connection 62 to 68 are closer to one another for each package connection, thus decreasing the effective spacing of the bridges 72 for each of the package connections 62-68 in the direction from the package 58 most distant from the carrier 60 to the package 52 closest to the carrier 60, and connected thereto.

Figure 5:
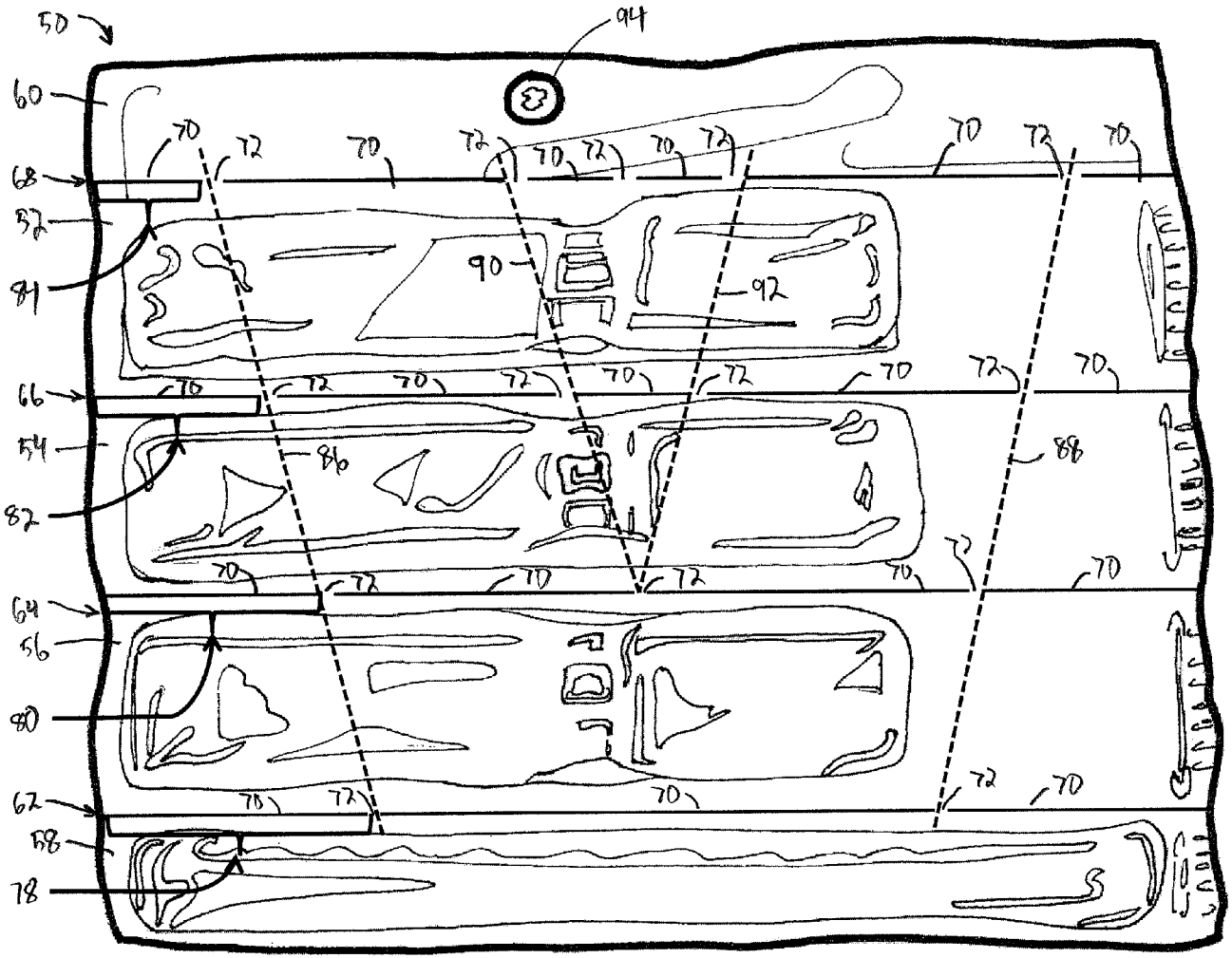
FIG. 5 is a view similar to FIG. 4, but with added nomenclature to help understand what is depicted.
Figure 6:
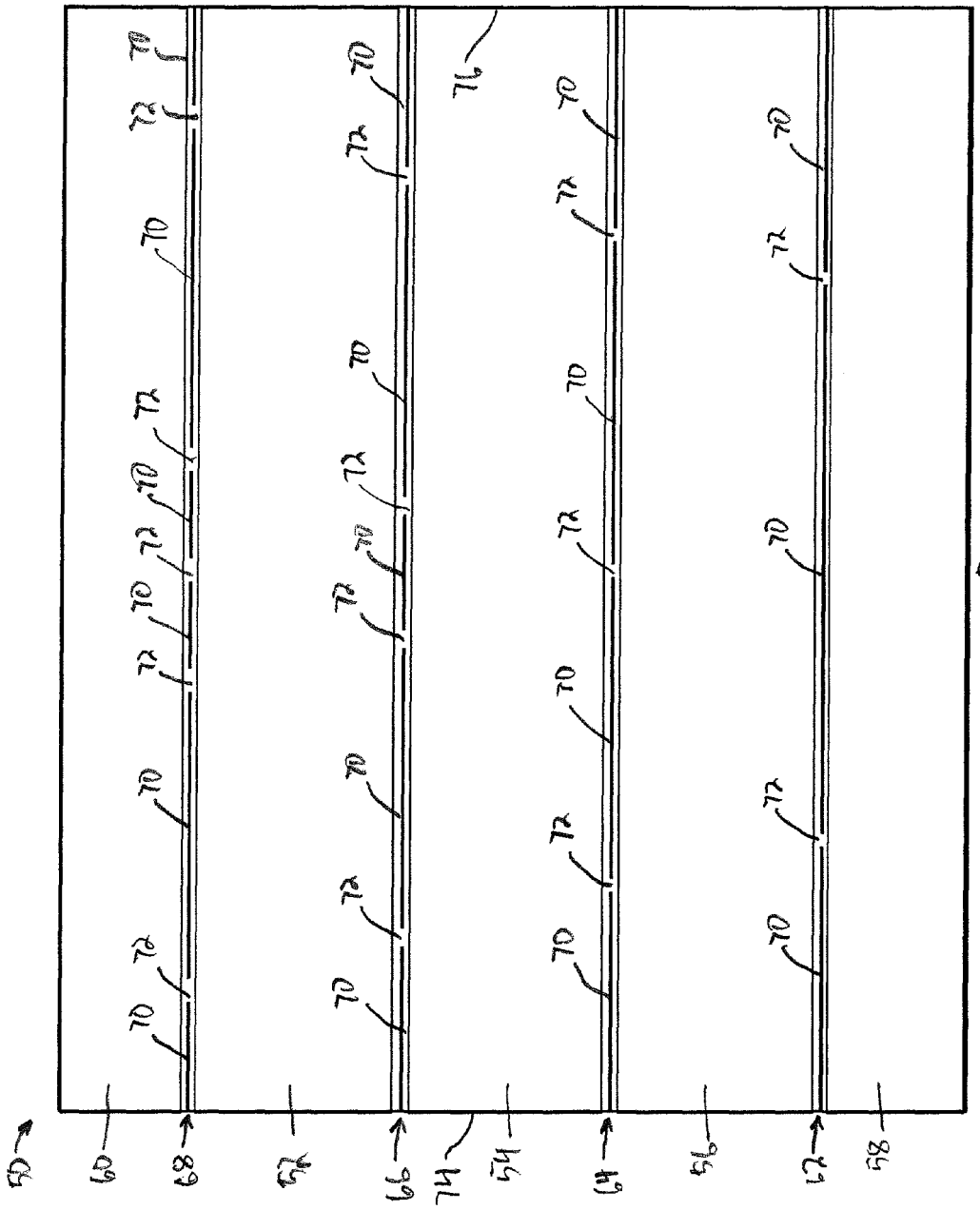
FIG. 6 is a view similar to FIG. 4, but without renditions of items in packages in order to improve clarity.
Figure 7:
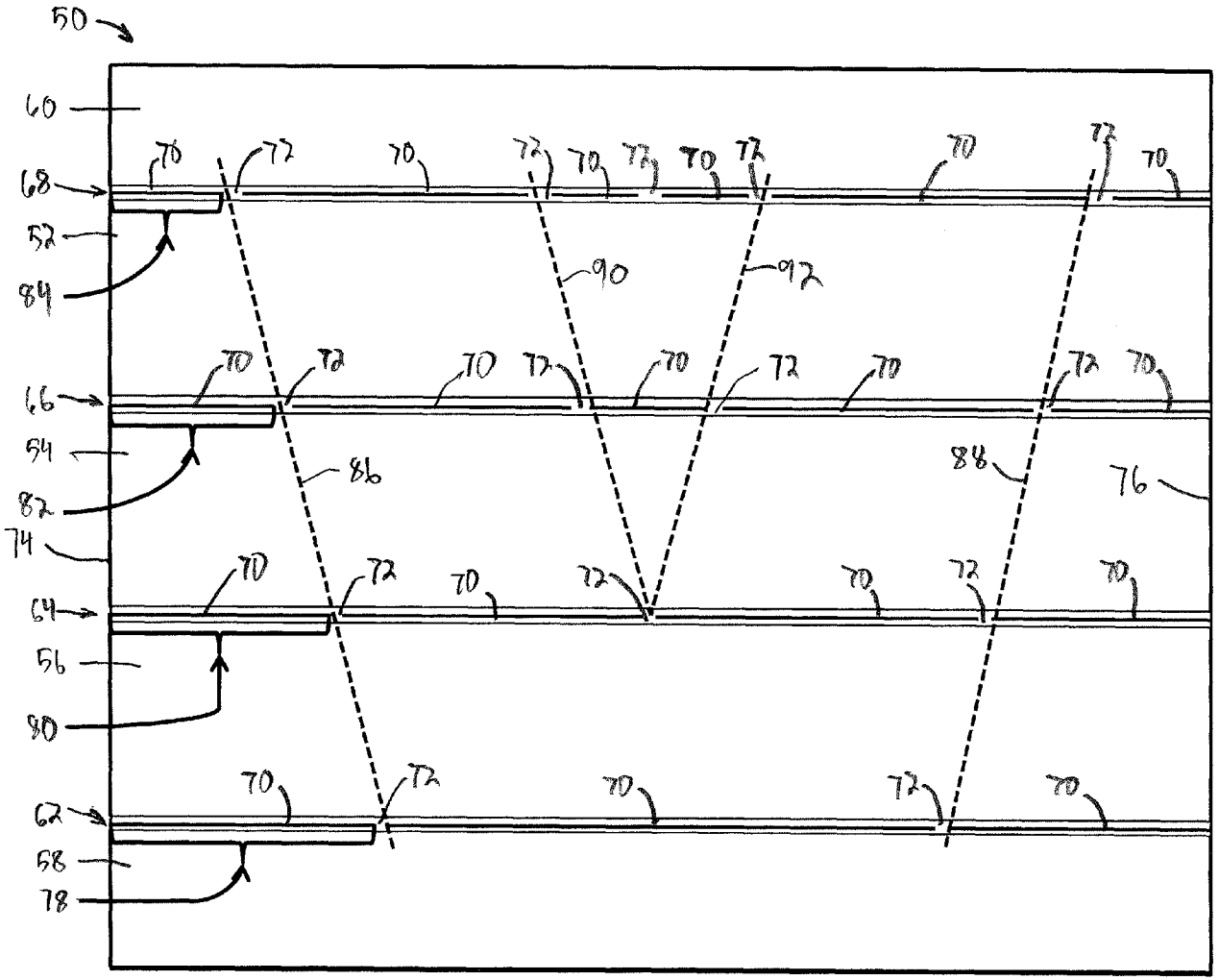
FIG. 7 is a view similar to FIG. 6, but with additional nomenclature to aid understanding what is depicted.

In addition, the outer bridges 72 for each of the package connections 62-68 commence at a start location spaced inwardly from an outer package edge, with the start location for each package connection decreasing in spacing from the outer package edge with increasing distance from the package most distant from the carrier 60. Opposite outer edges 74 and 76 are illustrated in FIGS. 6 and 7, while the outer edges are not crisply shown in FIGS. 4 and 5.

The outer bridges 72 of the package connection 62 have a spacing 78 from the outer package edges 74 and 76. Similarly, the outer bridges 72 of the package connection 64 have a spacing 80 from the outer package edges 74 and 76, the outer bridges 72 of the package connection 66 have a spacing 82 from the outer package edges 74 and 76, and the outer bridges 72 of the package connection 68 have a spacing 84 from the outer package edges 74 and 76. Thus, the outer bridges 72 of each of the package connections 62-68 are located along opposite lines of decreasing spacing 86 and 88 as shown. Similarly, the inner bridges 72 of the package connections 64-68 are located along opposite lines of bridge placement 90 and 92 as shown in FIGS. 5 and 7, with the lines 86 and 90 being parallel to one another, and the lines 88 and 92 being parallel to one another. If the number of packages is increased from those shown in the drawing figures, the numbers of bridges 72 and the location of the lines 86-92, and number of lines 90 and 92, will increase as will be evident from what is shown in the drawing figures and described above.

Various numbers of bridges, bridge widths, bridge spacings and edge spacings can be employed to accomplish the goal of increasing strength of the package connections for each package connection with increasing distance from the package most distant from the carrier 60. The following bridge table is but one example of formation of the package connections 62-68 to accomplish that goal:

Bridge Table

| Package Connection | # of bridges 72 | bridge 72 width | edge spacing (78-84) |
|---|---|---|---|
| 62 | 2 | 1.19 mm | 76 mm |
| 64 | 3 | 1.19 mm | 64 mm |
| 66 | 4 | 1.59 mm | 51 mm |
| 68 | 5 | 1.98 mm | 38 mm |

The above description is where the material forming the carrier 60 and the packages 52-58 is essentially the same, and therefore the package connections 62-68 are formed by the cut portions 70 with bridges 72 of desired width and location remaining. However, the goals of increasing package connection strength from bottom to top can also be accomplished other ways. For example, the thickness (as opposed to width) of the bridges 72 can increase from bottom to top. Similarly, the material of the bridges can be more robust from bottom to top, such as with increasing fibers or different material, therefore increasing the bridge strength. Other combinations will be evident.

Similar to the first form of FIGS. 1-3, the layers of FIGS. 4-7 are also connected together. To that end, the carriers 60 each include a hole 94 (not shown in FIGS. 6 and 7). A suitable connector, not illustrated, is used to permanently connect the layers in a stacked orientation, the connector passing through the holes 94.

Various changes can be made to the invention without departing from the spirit thereof or scope of the following claims.

What is claimed is:

1. A product dispensing system, comprising:

a. a plurality of layers of products, each layer having multiple items in separate packages, b. a carrier for each layer, said separate packages of each layer being secured to and extending in series from the carrier for each layer, with a first package being secured to the carrier for the layer, and each succeeding package being secured to the next preceding package, and c. the carrier and packages of each layer being secured to one another with successive package connections of increasing strength with increasing distance from a package most distant from said carrier, said successive package connections comprising progressive perforations, said progressive perforations including bridges for each package connection, with increasing numbers of bridges for each package connection from said package most distant from said carrier, and said bridges for each package connection increasing in width for package connections from said package most distant from said carrier to a package connection to said carrier.

2. The product dispensing system according to claim 1, in which said carrier comprises a separate carrier for each layer, said separate carriers being connected to one another.

3. The product dispensing system according to claim 1, in which said bridges for each package connection decrease in effective spacing for each package connection from said package most distant from said carrier.

4. The product dispensing system according to claim 1, in which said bridges for each package connection commence at a start location spaced inwardly from an outer package edge, with the start location for each package connection decreasing in spacing from said outer package edge with increasing distance from said package most distant from said carrier.

5. The product dispensing system according to claim 1, in which said bridges increase in strength for each package connection from said package most distant from said earner.

6. A product dispensing system, comprising a. a layer of products having multiple items in at least two separate packages, b. a carrier for said layer, said packages being secured to and extending in series from said carrier, with a first package secured to said carrier and each succeeding package being secured to the next preceding package, and c. said carrier and said packages being secured to one another with progressive perforations of increasing strength with increasing distance from a package most distant from said carrier, said progressive perforations including bridges for each package connection, with increasing numbers of bridges for each package connection from said package most distant from said carrier, and said bridges for each package connection increasing in width for package connections from said package most distant from said carrier to a package connection to said carrier.

7. The product dispensing system according to claim 6, in which said bridges for each package connection decrease in effective spacing for each package connection from said package most distant from said carrier.

8. The product dispensing system according to claim 6, in which said bridges for each package connection commence at a start location spaced inwardly from an outer package edge, with the start location for each package connection decreasing in spacing from said outer package edge with increasing distance from said package most distant from said carrier.

9. The product dispensing system according to claim 6, in which said bridges increase in strength for each package connection from said package most distant from said earner.

* * * * *